US006296475B1

(12) United States Patent
Tsai

(10) Patent No.: US 6,296,475 B1
(45) Date of Patent: Oct. 2, 2001

(54) GAS BURNER HAVING SYNCHRONOUS IGNITION AND GAS SUPPLY FUNCTIONS

(76) Inventor: Chin-Lin Tsai, 3F, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 0 days.

(21) Appl. No.: 09/481,383

(22) Filed: Jan. 12, 2000

(51) Int. Cl.[7] ..... F23D 11/36

(52) U.S. Cl. ..... 431/153; 431/255; 431/344; 126/413

(58) Field of Search ..... 431/344, 255, 431/153, 345; 126/406, 407, 408, 409, 413, 414

(56) References Cited

U.S. PATENT DOCUMENTS 4,552,124 * 11/1985 Nakajima ..... 126/413
4,641,632 * 2/1987 Nakajima ..... 126/406
5,083,440 * 1/1992 Yammamoto ..... 431/255
5,531,592 * 7/1996 Tasi ..... 431/255
5,771,880 * 6/1998 Tsai ..... 126/414
5,915,955 * 6/1999 Lin ..... 431/344

* cited by examiner

*Primary Examiner*—Carl D. Price
(74) *Attorney, Agent, or Firm*—Dougherty & Troxell

(57) ABSTRACT

A gas burner having synchronous ignition and gas supply functions includes a gas storing tank, a gas supply device, a housing, an ignition device, a retaining device, and a burning device. When a press button is pushed, the piezoelectric device is compressed so that a transverse rod is pushed by a push piece to cause a sliding piece and a driven piece to synchronously displace and a shaft spring to retract. The press button enters a wider portion of a lock-shaped hole via a narrower portion. A button spring stretches to cause the press button to be retained in the lock-shaped hole and extend from a piece hole. A gas nozzle is pulled out by a connecting groove for supply of fuel gas via the gas supply device to the burning device. Sparks generated by a lead wire ignites the fuel gas mixture.

17 Claims, 4 Drawing Sheets

GAS BURNER HAVING SYNCHRONOUS IGNITION AND GAS SUPPLY FUNCTIONS

BACKGROUND OF THE INVENTION (a) Field of the Invention

The present invention relates to a gas burner having synchronous ignition and gas supply functions, which can be operated in a simple and convenient manner, and which can be connected to other elements to achieve a multi-purpose gas burner.

(b) Description of the Prior Art

Gas burning devices are common in everyday life. Cigarette lighters are a good example. When using a cigarette lighter, the user has to continuously press a press plate to allow outflow of gas. If the press plate is released, gas is cut off. In circumstances where continuous fire supply is necessary, such as welding, a push/press button is needed to act on a gas supply nozzle of a gas tank to provide continuous supply of gas to a burning system.

Take U.S. Pat. No. 5,531,592 issued to the inventor and U.S. Pat. No. 5,082,440 as examples. In the hand-held type gas burners disclosed in these patents, a commercially available cigarette lighter is used as a fuel source. When a sliding key is pressed, it abuts against a press plate of the cigarette lighter so that the fuel gas flows to a burning device. Then, a piezoelectric means is pressed to ignite the fuel gas mixture. However, in these patents, the gas supply and ignition are proceeded in two steps. In operation, gas is supplied before the ignition step.

In U.S. Pat. Nos. 4,552,124 and 4,641,632 manual ignition is used. That is, after turning on a gas switch of a soldering device to allow passage of fuel gas to a burning device, a lighter or an ignition means provided on the soldering device gun is used to ignite the fuel gas mixture at a front end of the soldering device to heat a soldering iron. However, since the ignition means is separately provided, it is not very convenient in actual use.

SUMMARY OF THE INVENTION

A primary object of the present invention is to provide a gas burner having synchronous ignition and gas supply functions.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
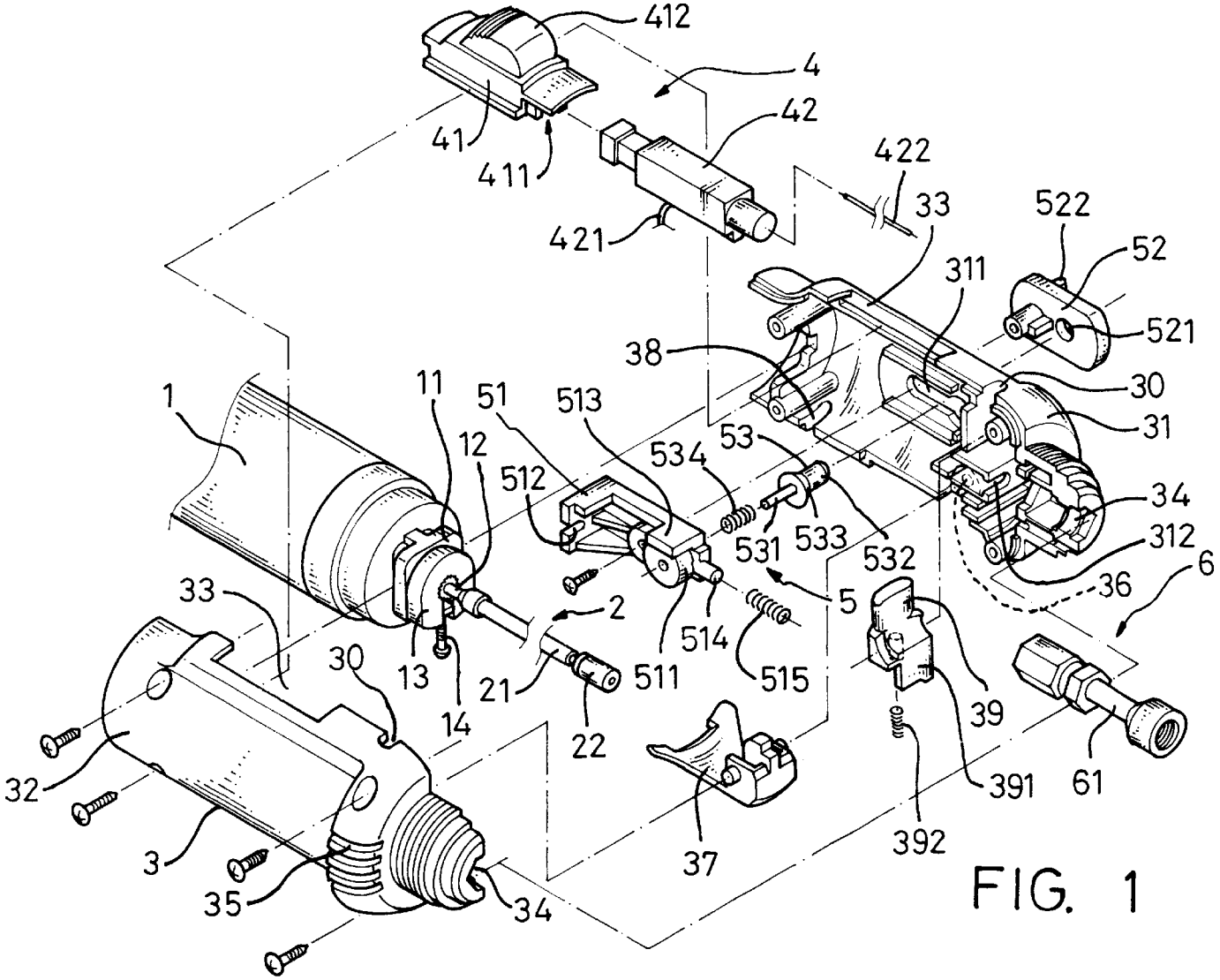
FIG. 1 is an exploded perspective view of the present invention.
Figure 2:
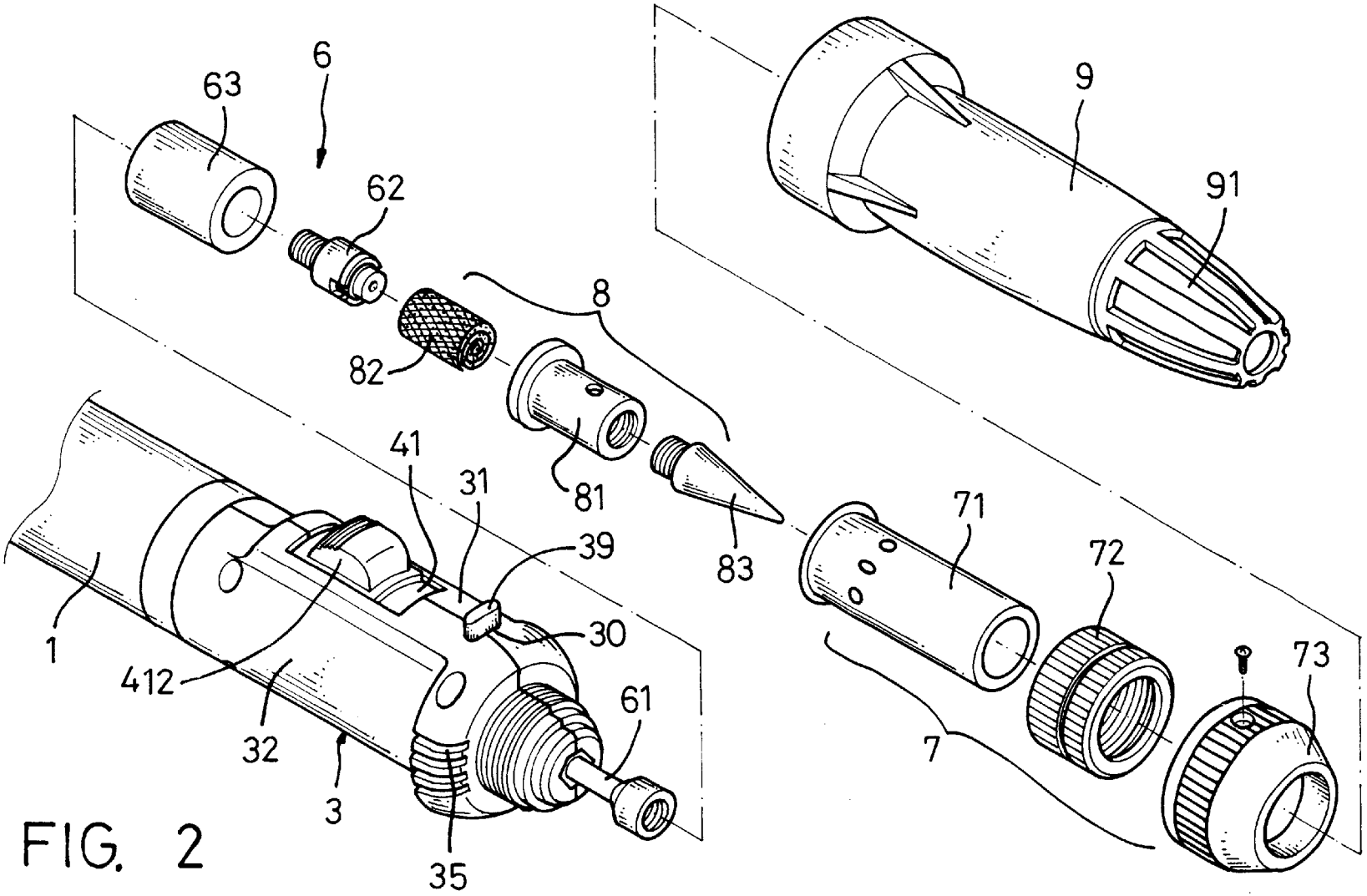
FIG. 2 is an exploded perspective view of the present invention and relevant components.

With reference to the drawings, the present invention is shown to include a gas storing tank 1, a gas supply device 2, a housing 3, an ignition device 4, a retaining device 5, and a burning device 6. The present invention may further be coupled with an external tube device 7 and an internal burning device 8 to form a multi-purpose gas burner.

The gas storing tank 1 is a container for containing liquefied gas. One end thereof has a conventional filler nozzle (not shown) for gas refilling. The other end thereof is provided with a connecting projection 11 for connection with the housing 3. A gas outlet nozzle 12 extends from the connecting projection 11 for pivotal connection with the gas supply device 2. The gas outlet nozzle 12 is further connected to a gas adjusting ring 13 one end of which has a gas adjusting rod 14 projecting therefrom. The gas adjusting rod 14 extends outwardly of the housing 3 and is turnable to control the output of fuel gas from the gas outlet nozzle 12.

The gas supply device 2 is a fuel gas transfer device, and includes a flexible gas guide tube 21 having one end pivotally connected to the gas outlet nozzle 12, with the other end thereof connected to a gas nozzle 22.

The housing 3 includes left and right housing portions 31, 32 in a butt joint relationship. After assembly, the housing 3 has a rear rend connected to the gas storing tank 1. The other end thereof receives the burning device 6 inserted therein. An upper portion of the housing 3 is provided with a hollowed housing chamber 33 for receiving and positioning the ignition device 4. A lock-shaped hole 311 is formed laterally in the left housing portion 31 for connecting and positioning the retaining device 5. The housing 3 further has an insert groove 312 and a tube groove 34 at a front end for receiving the gas nozzle 22 and a mixing tube 61, respectively. In addition, a plurality of air vents 35 are provided in the outer walls of the housing 3 on both sides of the insert groove 312 for circulation of air therethrough and along a clearance between the insert groove 312 and the tube groove 34, so that the fuel gas ejected from the gas nozzle 22 and the air can together enter the mixing tube 61 for mixing purposes. Furthermore, a front end of a bottom portion of the housing 3 is provided with a connecting portion 36 for connection with and turning of a Y-shaped leg support 37, whereby when the leg support 37 is extended, the entire gas burner can be erected obliquely. In addition, the housing 3 is provided with a curved groove 38 corresponding to the gas adjusting rod 14 for extension of the latter.

Figure 3:
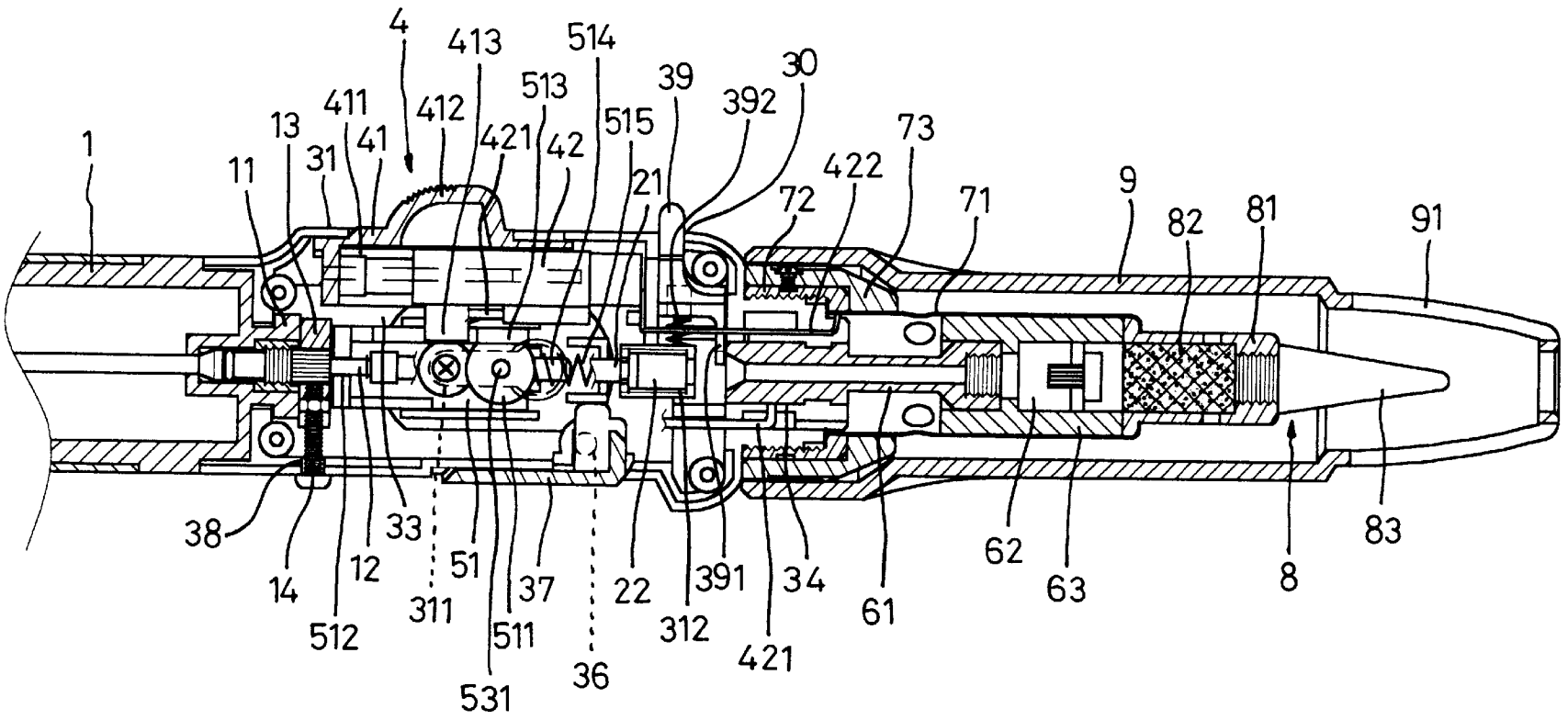
FIG. 3 is a sectional assembled view of FIG. 2.

The ignition device 4 includes a push key 41 having a key chamber 411 formed at a bottom portion thereof, and a piezoelectric device 42 received in the key chamber 411. The ignition device 4 along with the piezoelectric device 42 is positioned in the housing chamber 33 such that a key button 412 on a top portion of the push key 41 is exposed on the housing 3 to facilitate manipulation. A push piece 413 (see FIG. 3) extends integrally from the push key 41 near the retaining device 5. When the push key 41 is pushed forwardly, the piezoelectric device 42 will be pushed simultaneously so that electric currents via a lead wire 421 on one side of the piezoelectric device 42 to directly or indirectly generate sparks at a flame nozzle 62 of the burning device 6 to ignite the fuel gas mixture. A current return wire 422 is further provided to guide the electric currents back to the piezoelectric device 42, thereby forming a loop.

Figure 5:
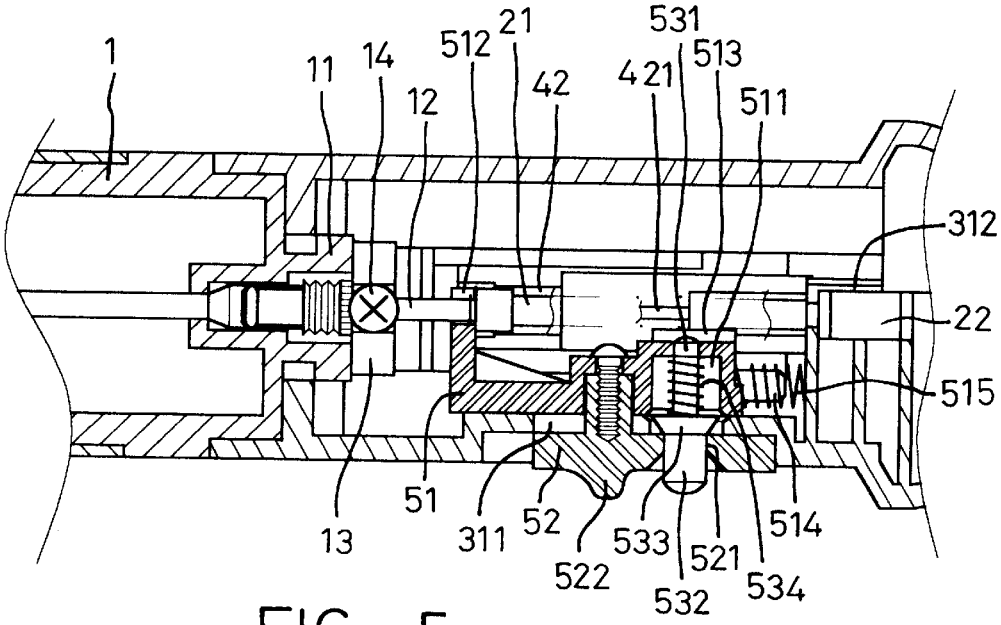
FIG. 5 is a sectional view of the present invention in part, after operation.

The retaining device 5 includes an L-shaped sliding piece 51 and a driven piece 52 that are butt joined on both sides of the lock-shaped hole 311. One side of the sliding piece 51 is provided with a button chamber 511. After a button rod 531 and a button spring 534 of a press button 53 has been assembled, they can displace transversely inside the button chamber 511, and a button end 532 at the other end extends from a piece hole 521 of the driven piece 52, with a tapered disk 533 at an intermediate section touching the piece hole 521 as the limit for extension. A rear end of the sliding piece 51 is provided with a connecting groove 51 for connection with the gas outlet nozzle 12. A top portion thereof is provided with a transverse block 513 for abutting the above-mentioned push piece 413. In addition, a piece shaft 514 at a front end of the sliding piece 51 is connected to a shaft spring 515 and then abuts against the inner walls of the housing 3. When the key button 412 of the push key 41 is pushed, the push piece 413 below synchronously displace to push the transverse block 513 so that the tapered disk 533 advances firstly through a narrow portion of the lock-shaped hole 311. When the tapered disk 533 displaces to a wider portion of the lock-shaped hole 311, it abuts against the piece hole 521 and is positioned in the wider portion. At this time, the connecting groove 512 pulls the gas outlet nozzle 12 to a position for gas supply, while the button end 532 projects from the piece hole 521 in a position slightly lower than a piece projection 522 (see FIG. 5) of the driven piece 52 to avoid contacting the press button 53. It can therefore be appreciated from the aforesaid that it is only necessary to push the push key 41 to cause the sliding piece 51 and the driven piece 52 to synchronously displace, and by retaining the press button 53 in the lock-shaped hole 311, the sliding piece 51 and the driven piece 52 can be positioned. By pulling out the gas outlet nozzle 12, fuel gas can flow from the gas supply device 5 to the burning device 6 to be synchronously ignited by means of the piezoelectric device 42.

Figure 4:
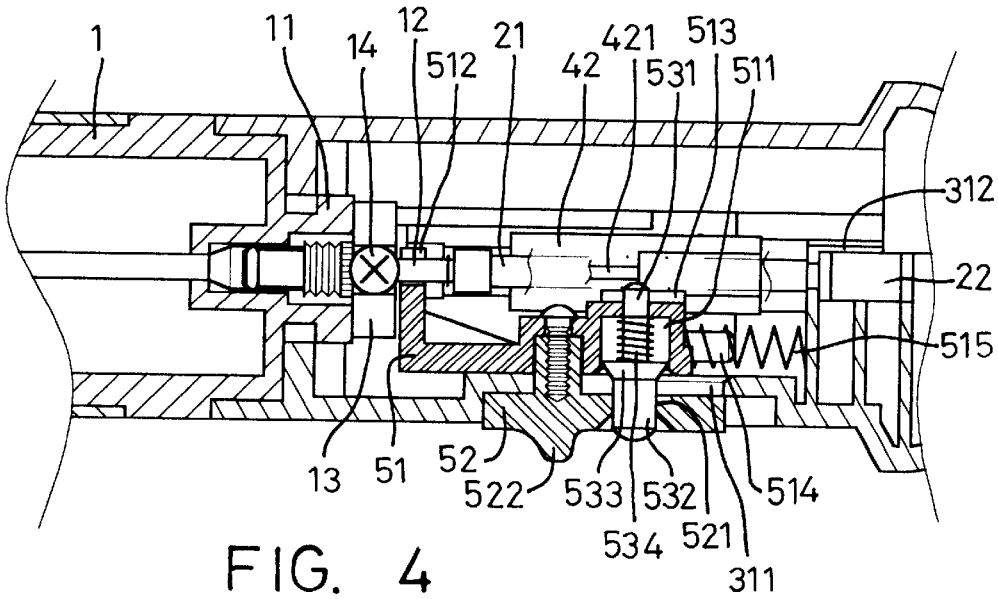
FIG. 4 is a sectional view of the present invention in part, prior to operation.

With reference to FIG. 4, to stop the supply of fuel gas, it is only necessary to press the press button 53 so that the tapered disk 533 compresses the button spring 534 and displaces to disengage from the lock-shaped hole 311. At this time, the shaft spring 515 stretches and pushes the sliding piece 51 to reset, so that the gas outlet nozzle 12 retracts to a position where fuel gas supply is stopped.

Furthermore, in order to prevent the flame of the burning device 6 from getting too strong, a button slot 30 is provided on the surface of the housing 3 above the insert groove 312 for receiving a gas control button 39. The gas control button 39 has a shielding piece 391 extending from one side, the other side thereof being connected with a press spring 392. When the gas control button 39 is pressed, the press spring 392 is compressed so that the shielding piece 352 blocks the gas nozzle 22, thereby preventing direct entry of fuel gas into the burning device 6. When the gas control button 39 is released, the fuel gas can once more enter the burning device 6.

The burning device 6 includes a mixing tube 61 secured at the front end of the housing 3 to receive the fuel gas and air transferred from the gas nozzle 22 for mixing therein. The flame nozzle 62 is connected to a heat insulating sleeve 63 before being connected to the mixing tube 61. The mixture of fuel gas is ejected from the flame nozzle 62 and ignited by the lead wire 421 to achieve a gas burner.

Furthermore, the burning device 6 of the present invention may be connected to the external tube device 7 and the internal burning device 8 to form a multi-purpose gas burner. The external tube device 7 includes an outer tube 71 connected to the end portion of the housing 3. A metallic inner ring 72 and an outer ring 73 are firstly coupled and then locked to the end portion of the housing 3 so that the outer tube 71 is secured on one side of the housing 3. The internal burning device 8 includes an inner tube 81 secured at a free end of the outer tube 71 so that the flame will not be exposed on the outside and a heating device is achieved. The inner tube may receive a catalyzer 82 in a curled state to achieve a preferred internal flame. Furthermore, a soldering iron 83 may be pivotally connected to a front end of the inner tube 81 to serve as a soldering device.

The lead wire 421 of the piezoelectric device 42 contacts the mixing tube 61 in the tube groove 34 so that electric currents flow through the mixing tube 61 and the flame nozzle 62 and sparks are generated between the inner tube 81 and the flame nozzle 62. The return wire 422 is held between the outer tube 71 and the inner ring 72 and, by means of the inner tube 81, forms a return loop.

To better store and protect the components on the outside of the housing 3 when the heat has not been completely dissipated, the outer ring 73 may be connected to a hood 9 for covering the exposed components. The hood 9 may be formed with a plurality of heat dissipating slots 91 corresponding to the soldering iron 83 to allow quicker cooling of the soldering iron 83.

In the present invention, pushing of the push key can simultaneously bring the retaining device to displace and be positioned so that the fuel gas in the gas storing tank can be guided from the gas nozzle that is linked-up with the sliding piece, and by means of the gas supply device, the fuel gas and the air are together sent to the burning device for mixing and then ejection from the flame nozzle. The ejected fuel gas is then ignited by means of the piezoelectric device. It can therefore be seen that the operation of the present invention is very simple and convenient compared to the prior art. Besides, the present invention may be additionally connected to other accessories, such as an external tube device and an internal burning device, to achieve a multi-purpose gas burner. The provision of the gas control button also allows the user to interrupt supply of fuel gas to prevent the catalyzer from being burned by strong flames, thereby prolonging the useful life of the catalyzer.

Although the present invention has been illustrated and described with reference to the preferred embodiment thereof, it should be understood that it is in no way limited to the details of such embodiment but is capable of numerous modifications within the scope of the appended claims.

What is claimed is:

1. A gas burner having synchronous ignition and gas supply functions, comprising: a housing connected to a gas storing tank and a burning device, said gas storing tank having a gas outlet nozzle connected to a gas supply device to deliver fuel gas to said burning device, said housing having a top portion with a housing chamber containing a piezoelectric ignition device, one side being provided with a lock-shaped hole with a retaining device; a plurality of air vents formed in said housing for entry of air into said housing and through a clearance between said gas supply device and said burning device into said burning device along with the fuel gas; said piezoelectric ignition device having a push key; a lead wire of the piezoelectric ignition device extending to said burning device; said retaining device including a sliding piece and a driven piece butt joined on sides of said lock-shaped hole, with a press button having a button spring; a connecting groove at a rear end of said sliding piece connecting said gas outlet nozzle, a top portion thereof being provided with a transverse block that abuts against a push piece, a front end thereof being provided with a piece shaft connected with a shaft spring; and said driven piece having a piece hole corresponding to said press button, whereby when said press button is pushed, said piezoelectric ignition device is compressed so that said transverse block is pushed by said push piece to cause said sliding piece and said driven piece to be synchronously displaced and the shaft spring to retract, said press button entering a wider portion of said lock-shaped hole via a narrower portion, said button spring stretching to cause said press button to be retained in said lock-shaped hole and extend from said piece hole, a gas nozzle being pulled out by said connecting groove for supply of fuel gas via said gas supply device to said burning device, sparks generated by said lead wire igniting the fuel gas mixture.

2. The gas burner as defined in claim 1, wherein said gas outlet nozzle is connected to a gas adjusting ring which has a gas adjusting rod extending from a curved groove of said housing, said gas adjusting rod being adjustable to regulate the flow of fuel gas.

3. The gas burner as defined in claim 1, wherein said gas supply device includes a flexible gas guide tube connected between said gas outlet nozzle and said gas nozzle.

4. The gas burner as defined in claim 1, wherein said housing has a front end provided with a tube groove for connection with said gas supply device, a clearance being defined between said tube groove and said insert groove to facilitate entry of air into said burning device.

5. The gas burner as defined in claim 1, wherein said housing has a connecting portion provided at a front end of a bottom portion pivotally connected with a leg support, said leg support being closable or extendable with respect to said housing.

6. The gas burner as defined in claim 1, further comprising a gas control button including a shielding piece extending from a bottom portion thereof and a press spring, said housing having a button groove formed in an upper portion for receiving said gas control button, whereby when said gas control button is pressed, said shielding piece shields said gas nozzle to stop the supply of fuel gas.

7. The gas burner as defined in claim 1, wherein said push key has a top portion provided with a key button to facilitate manipulation.

8. The gas burner as defined in claim 1, wherein said piezoelectric ignition device further has a return wire.

9. The gas burner as defined in claim 1, wherein said press button has a button rod at a rear end connected to said button spring and is disposed in a button chamber of said sliding piece, with a button end at a front end received in said piece hole of said driven piece, a tapered disk at an intermediate section displacing through said narrower portion of said lock-shaped hole into said wider portion to thereby position said sliding piece and said driven piece in said lock-shaped hole, said button spring stretching and extending from said piece hole of said button end.

10. The gas burner as defined in claim 9, wherein a surface of said driven piece is provided with a projection that has a height greater than the greatest height of the button end extending from said piece hole to avoid contact therewith.

11. The gas burner as defined in claim 1, wherein said burning device includes a mixing tube secured in said tube groove of said housing, a flame nozzle being disposed in a heat insulating sleeve and connected to said mixing tube to eject the mixture of fuel gas.

12. The gas burner as defined in claim 1, further comprising an external tube device and an internal burning device, said external tube device including a metallic outer tube connected to a front end of said housing, a metallic inner ring disposed in an outer ring and connected to said front end of said housing, said internal burning device including an inner tube disposed in an outer tube and extending from a free end.

13. The gas burner as defined in claim 12, wherein said inner tube has a catalyzer disposed inside to achieve a preferred internal burning effect.

14. The gas burner as defined in claim 13, wherein said catalyzer is in a curled state.

15. The gas burner as defined in claim 12, wherein a front end of said inner tube is connected to a soldering iron to serve as a soldering device.

16. The gas burner as defined in claim 1, further comprising a hood connected to said front end of said housing to cover exposed components.

17. The gas burner as defined in claim 16, wherein said hood is formed with a plurality of heat dissipating slots.

* * * * *